US005419092A

United States Patent [19]

Jaecklin

[11] Patent Number: 5,419,092

[45] Date of Patent: May 30, 1995

[54] STRUCTURES AND PROCESS FOR PRODUCING SAME, AS WELL AS ASSOCIATED ELEMENTS AND SETS OF CONSTRUCTION ELEMENTS

[76] Inventor: Felix P. Jaecklin, Ennetbaden, CH 5400, Switzerland

[21] Appl. No.: 856,210

[22] PCT Filed: Sep. 16, 1991

[86] PCT No.: PCT/EP91/01762

§ 371 Date: Jul. 15, 1992

§ 102(e) Date: Jul. 15, 1992

[87] PCT Pub. No.: WO92/05318

PCT Pub. Date: Apr. 2, 1992

[30] Foreign Application Priority Data

Sep. 16, 1990 [CH] Switzerland ..... 02987/90
Feb. 12, 1991 [DE] Germany ..... 41 04 247.6

[51] Int. Cl.[6] ..... E04B 1/02; E04C 3/30; E02D 3/02; E02D 5/00

[52] U.S. Cl. ..... 52/562; 52/169.4; 52/568; 405/284

[58] Field of Search ..... 52/563, 564, 562, 568, 52/169.4; 405/284, 258, 262

[56] References Cited

U.S. PATENT DOCUMENTS

| | | | |
|---|---|---|---|
| 4,470,728 | 9/1984 | Broadbent | 405/284 |
| 4,818,150 | 4/1989 | Jaecklin | 405/284 X |
| 4,920,712 | 5/1990 | Dean, Jr. | 52/562 X |
| 5,044,834 | 9/1991 | Janopaul, Jr. | 52/562 X |
| 5,257,880 | 11/1993 | Janopaul, Jr. | 52/562 X |

*Primary Examiner*—Neill R. Wilson
*Attorney, Agent, or Firm*—Tarolli, Sunheim & Covell

[57] ABSTRACT

A retaining wall includes a fore-structure including a material supporting member, at least one abutment on the material supporting member, and at least one solid body anchor member. A bulk material filling is disposed rearward of the fore-structure and has a portion acting with a forwardly-directed force on the fore-structure. A flexible sheet material member interconnects the fore-structure and the bulk material filling for resisting forward movement of the fore-structure under the influence of the forwardly-directed force. The solid body anchor member is disposed forward of an abutment surface on the abutment, and the abutment surface blocks rearward movement of the solid body anchor member relative to the material supporting member. The sheet material member has a loop section extending at least partially around the solid body anchor member. At least a portion of the loop section extends between the solid body anchor member and the abutment surface. The sheet material member has first and second end sections connected with the loop section. The end sections extend rearward from the loop section and from the fore-structure in a direction into the bulk material filling. The end sections are disposed in an overlying force-transmitting relationship with each other, and are anchored in the bulk material filling to place the sheet material member in tension under the influence of the forwardly-directed force. The abutment surface extends in a direction generally transverse to the direction of tension of the sheet material member.

35 Claims, 7 Drawing Sheets

STRUCTURES AND PROCESS FOR PRODUCING SAME, AS WELL AS ASSOCIATED ELEMENTS AND SETS OF CONSTRUCTION ELEMENTS

BACKGROUND OF THE INVENTION

1. Field of the Invention

The invention relates to structures, particularly lattice structures, for example in the form of retaining walls for slopes or room-dividing supporting walls, as well as a process for the manufacture of such structures. Furthermore, the invention relates to associated construction elements and sets of construction elements.

2. Description of the Prior Art

With support structures of the present type, in the interest of its technical and economical success, it is important to produce the frictionally-linked or form-locking connection between the fore-part and the bulk filler in as simple but also in as effective a manner as possible. As known, the mentioned connection is achieved by an arrangement of the material lengths in such a way that they loop around anchors connected with the fore-part or its structural elements and then extend into the bulk filler, where they are in turn anchored due to static friction and/or denticulation. However, during this process, a guiding of lengths of flat materials through recesses in the structural elements—a costly work process-is to be avoided. Simultaneously, a structural form of the structural elements and of the anchors, which can be produced in a simple and cost-efficient manner, is sought.

SUMMARY OF THE INVENTION

A primary task of the invention is the creation of a support structure in which the aforementioned requirements are met. The task extends further to a process wherein the bulk filling behind chessboard-like fore-parts, as preferably used for support structures of the present type, can be compressed in a rapid and disturbance-free manner, i.e., most of all without forcing the bulk filler through the gaps of the chessboard-like arrangement.

Another task of the invention is the creation of structures or associated construction elements and sets of construction elements which create an advance, i.e., with respect to stability of the structure, as well as to the stability of its interior linkage between the lattice-structured fore-part and the load-bearing structure located behind it, and with respect to the stability of the structural components themselves. Furthermore, one aspect of the task of the invention is directed toward a reduction in the manufacturing costs, i.e. toward the cost of the construction elements as well as the actual erection of the structure. In this connection, the invention also addresses the manufacturing processes. An additional aspect of the task of the invention is directed toward an improvement of the facade area of the structure with respect to technical function and aesthetic form.

The solution to this task of the invention is determined in a number of variations by the characteristics of the patent claims.

BRIEF DESCRIPTION OF THE DRAWING

The characteristics and advantages of the invention are explained in detail by means of the examples which are schematically illustrated in the drawings.

DESCRIPTION OF THE PREFERRED EMBODIMENTS

Figure 1:
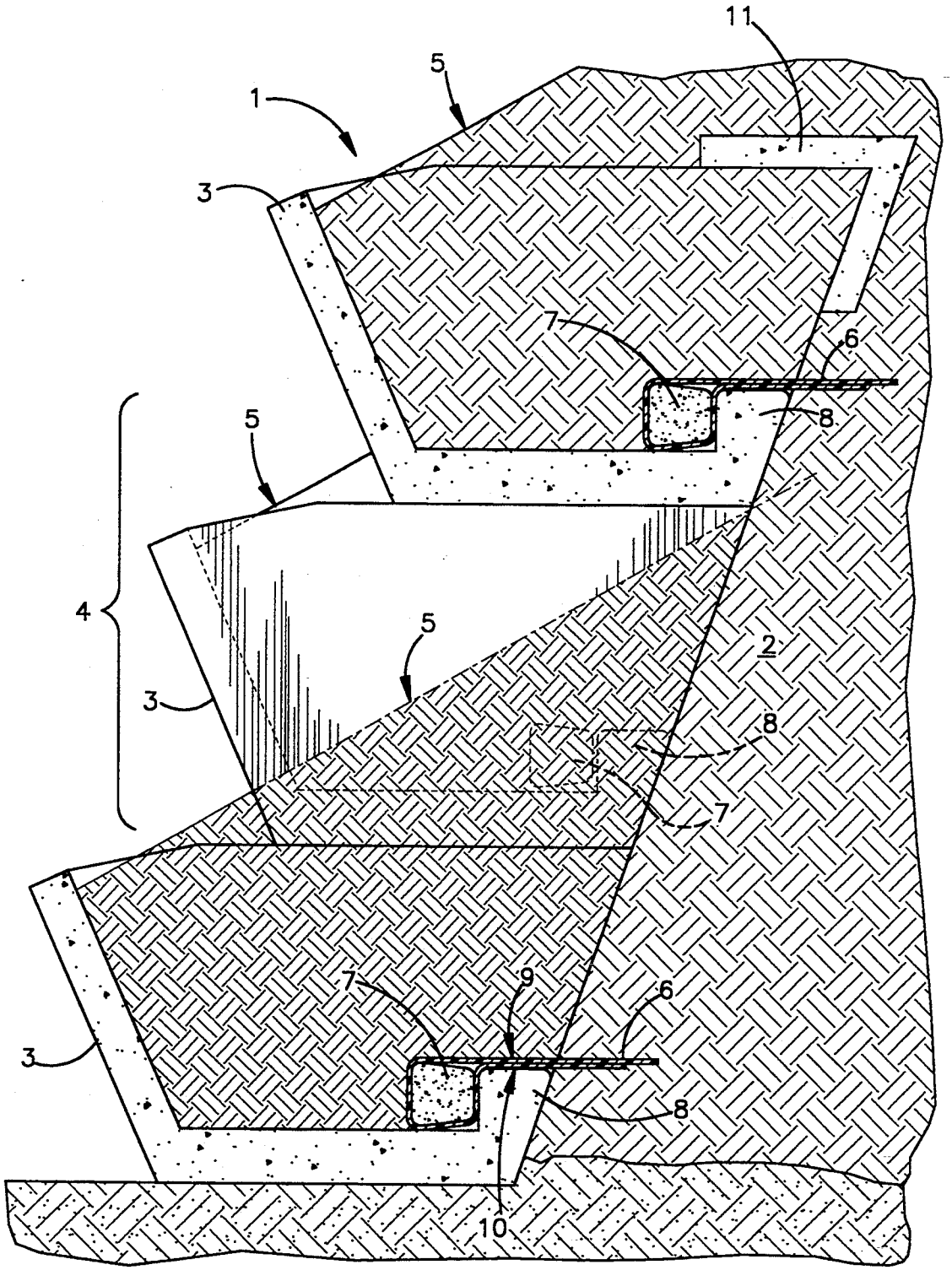
FIG. 1 is a vertical cross-section showing a structure in accordance with a first embodiment of the present invention.

A first arrangement of the invention is explained by means of the structure shown schematically in FIG. 1 in vertical cross section.

The structure, a suspended structure formed as a lattice construction, consists of a fore-part (1) and a bulk filler (2), which is essentially arranged behind the pre-structure. The pre-structure comprises a number of frame- or trough-like structural elements (3) which, when viewed toward the front of the structure, are arranged in chessboard-like distribution either adjacent to each other or one on top of the other. In this way, inside the wall front between the structural elements, also chessboard-like gaps (4) are created. The bulk material extends into these hollow spaces (5) of the structural elements (3) and into these gaps (4) of the wall front in order to create here a number of evenly distributed batters (5).

The fore-part and bulk filler, through a number of flexible flat bracing elements (6), so-called "geotextile lengths," are frictionally-connected with each other through tensile force in a form-locking manner. The wall fore-part, for a number of structural elements, has at least one corresponding anchoring element (7), surrounded entirely or partially by a flat bracing element (6) which is connected with the wall fore-part (1) in a load-transmitted manner. The flat bracing elements extend from the wall fore-part into the bulk filler and are anchored in same through weight distribution and compression in a form-locking or frictionally-connected manner. In this way, the fore-part, which in itself is not fixed or which may even require support, forms a stable unit together with the equally nonfixed bulk filler.

The anchors grip behind abutment (8), formed in the area of the rear of the fore-part and protruding freely in an upward direction essentially transverse to the direction of pull of the flat bracing elements. In this manner, a form-locking connection is established between the anchor and the structural element. The flat bracing elements extend, after looping around the anchor with at least partially-adjoining to-and-return strand (9 or 10), beyond the abutment toward the bulk filler. An arrangement wherein the abutment protrudes from above in a downward direction may also be considered. In the example, the flat bracing elements extend between the anchor and the abutment so that a desired bracing of the material lengths results. However, a merely partial looping around the anchors or an absent or merely partial extension of the bracing elements between the anchor and the abutment is also considered. With the advantage of a simple form and producibility, in the example, the abutments are arranged at the rear of the structural elements and formed as strip-like flanges with a longitudinal edge which freely protrudes in an upward direction.

During the manufacture of the structure, the bulk filler is introduced and compressed in layers at the rear of the fore-part in accordance with the layered erection of the fore-part.

During the introduction and/or compression of one layer of bulk filler, the gaps between the horizontally adjacent structural elements of a layer are bridged by at least one support carrier (11), which at least at its end sections has an angular profile and supports itself while maintaining this profile in the horizontal and vertical directions on the respectively adjacent structural elements, and for its part, supports the bulk filler, located in the respective gap, against displacement toward the front of the structure.

Figure 1A:
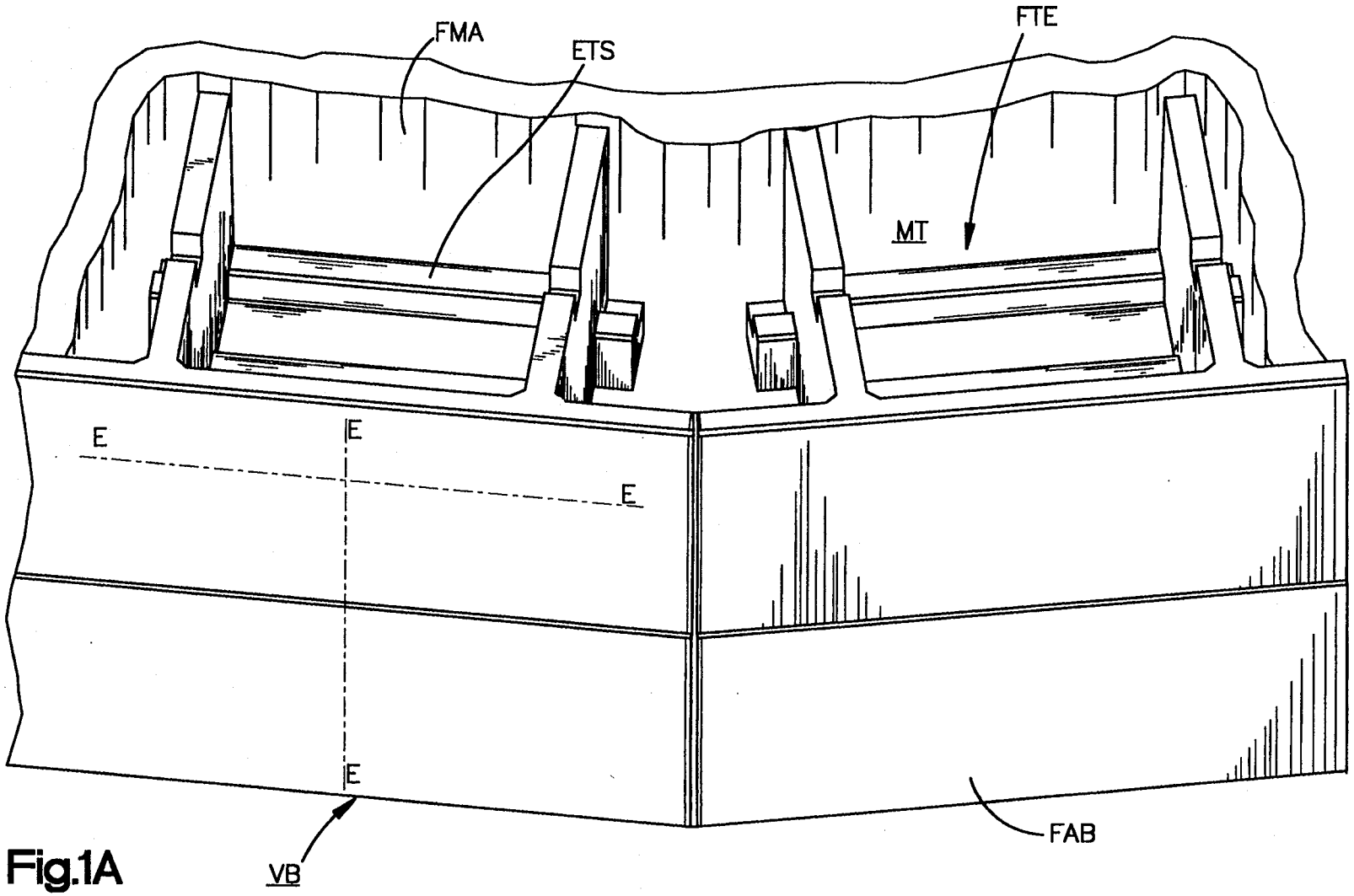
FIG. 1*a* illustrates a lattice structure constructed in accordance with a second embodiment of the present invention.

Another arrangement of the invention is shown in the perspective view of FIG. 1*a*. Here, a lattice structure is involved, in fact, an embankment wall, with a fore-part (VB), which is constructed as a lattice structure from solid support elements (FTE) and with a load-bearing structure (MT) containing loose or solidified filler (FMK), is connected in a form-locking and/or frictionally-connected manner with the fore-part. It may possibly be advantageous to unite several fore-parts and several load-bearing structures through an appropriate form-locking or frictionally-connected linkage into a total structure. In the fore-part (VB), a number of box- and frame-like support elements (FTE), having preferably flat front sections (FAB), is arranged along the width and height in a grid-like distribution. At least one portion of the support elements (FTE), intermediate support elements (ZTF or ZTS) are provided which preferably extend horizontally and along the wall plane (E—E) and are connected with adjacent sections of the lattice support elements.

Figure 2:
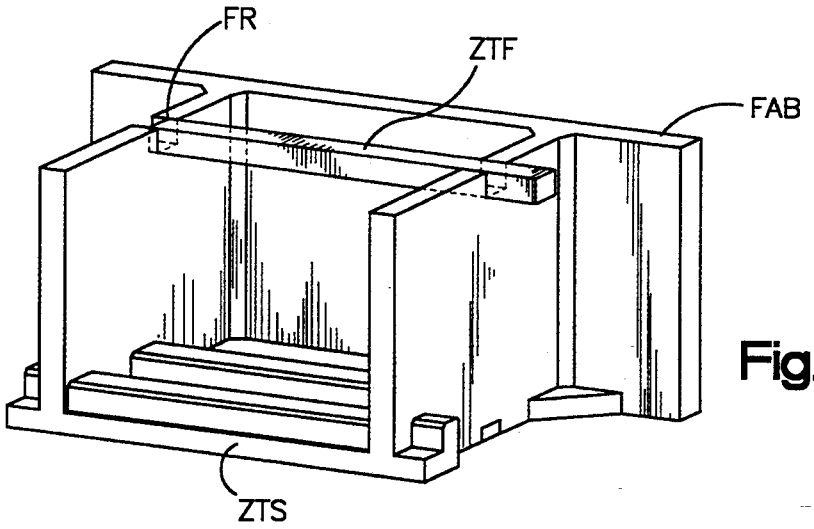
FIG. 2 is an enlarged rear view of a portion of the structure of FIG. 1*a;*
Figure 3:
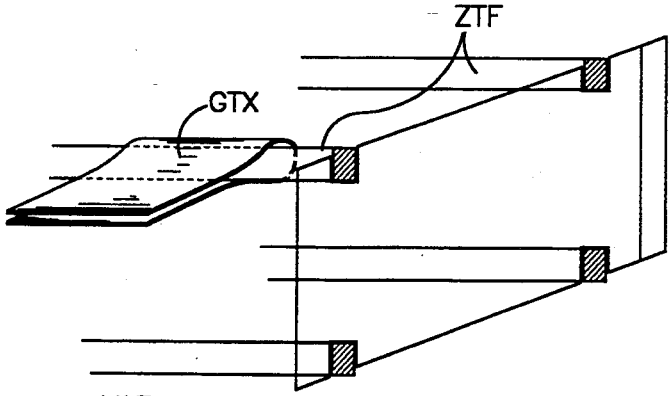
FIG. 3 is a view similar to FIG. 2.

In detail, in the arrangements according to FIGS. 2 and 3, intermediate support elements (ZTF) [are provided], which are connected through form-locking notch connections (FR) with adjacent sections of the same lattice support element. Furthermore, with these arrangements, other intermediate support elements (ZTS) are connected in a retentive manner, particularly in a single piece, with adjacent sections of the same lattice support element. Depending on the existing static demands and soil conditions, such intermediate support elements may be connected with a front area and/or a rear area of a lattice support element or of two adjacent lattice support elements. Indications to that effect are shown in the mentioned figures also for the lower or upper areas of a lattice support element. These varying arrangements offer different advantages. A rearward arrangement of the intermediate support element permits preferably an additional support or anchoring function between the respective main support element and the bulk filler of the load-bearing structure by embedding an intermediate support element or more of same in the pourable or also solidified bulk filler. An arrangement in the front, and mostly also in the upper area of the main support element, however, is preferably taken into consideration for additional holding of plantable bulk filler in the fore-part. An arrangement in the lower and mostly also in the rearward area of the main support element offers advantages, for example, with respect to an additional anchoring function by means of flexible anchoring elements, particularly in the form of geotextile lengths (GTX), which, on the one hand, loop around an intermediate support element or around several of these and, on the other hand, are form-locked and/or frictionally-connected with the bulk filler of the load-bearing structure.

Figure 4:
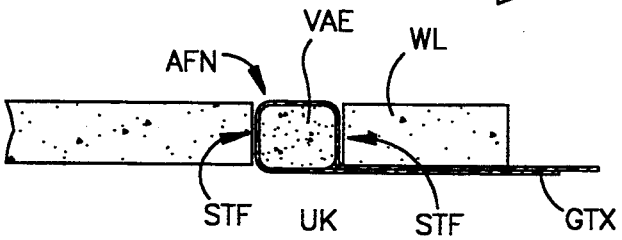
FIG. 4 illustrates an anchor connection in accordance with another embodiment of the invention.
Figure 5:
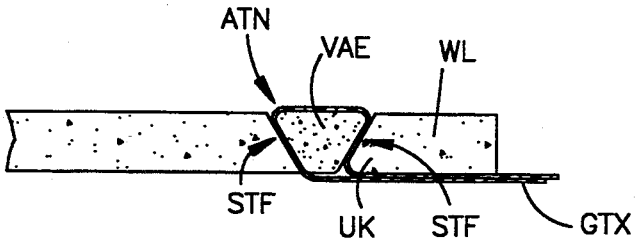
FIG. 5 is a view similar to FIG. 4 showing another anchor construction.
Figure 6:
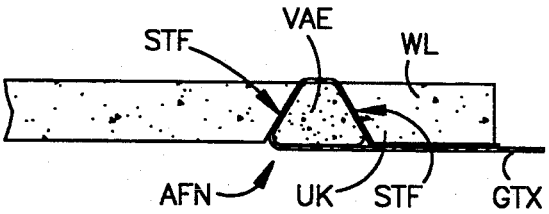
FIG. 6 is a view similar to FIG. 5 showing yet another anchor construction.

The FIGS. 4 to 6 show special arrangements of a frictionally-connected or even form-locking arrangement of the fore-part or its support elements with the bulk filler of the load-bearing structure through a flexible, preferably flat, pulling-anchoring element (GTX), or more of same. For this purpose, for at least one lattice support element, at least one at least partially elongated anchoring connection element (VAE) is provided which extends essentially transverse to the anchoring direction of pull, which is surrounded, at least in part, by at least one such anchoring element, preferably a geotextile length. At the lattice support element itself, at least one abutment (WL), which is effectively connected with the anchoring connection element, is provided with at least one support surface (STF), extending at an angle, preferably transversely, to the anchoring direction of pull and with at least one deflection edge (UK) protruding in a downward direction and extending also at an angle, preferably transversely, to the anchoring direction of pull for the flexible anchoring element. The flexible anchoring element extends underneath this deflection edge into the bulk filler of the load-bearing structure. Such an arrangement favors an elongation of the anchoring element inside the bulk filler opposite the deflection edge and thus permits a taught anchoring. Furthermore, the occurrence of overturning moments having an effect on the anchoring connection element is prevented.

In the latter mentioned arrangements, the abutment for the anchoring connection element which here, for example, is rod-like, is constructed in such a way that the result is an at least in part a form-locking seat (AFN), here particularly groove- or slit-like, with at least two opposing support surfaces (STF), equally extending, at least in part, at an angle, preferably transverse to the anchoring direction of pull for the anchoring connection element. In accordance with FIGS. 5 and 6, the beam and seat cross section is trapezoided or wedge-like, whereby, in a simple manner, the possibility of a secure wedging of the connection element at the support element is achieved.

With the arrangement in accordance with FIG. 5, a pulling-through of the geotextile length through the slit-like seat from above is required; however, this is offset by the advantage of an absolutely secure form-locking connection with the support element, mostly when the geotextile loop wrapping around the connection element is secured through a knotted or welded seam. For this arrangement, the following particularly advantageous structural process results:

a primary bearing surface, possibly with inserted foundation or support elements, is planned from pourable or solidifiable bulk filler;

in alignment, in accordance with a predetermined position, at least one lattice support element, which is provided with at least one preferably rod-like anchoring connection element and at least one flexible anchoring element surrounding same, at least in part and preferably in rolled up form, is applied to the supporting surface;

the flexible anchoring element is laid out in stretched form on the supporting surface in the provided anchoring direction of pull;

possibly after additional attachment of the flexible anchoring element in the bulk filler, located behind the lattice support element on the supporting surface and the flexible anchoring element laid out there, bulk filler is applied and preferably compacted, and preferably on the level of the upper edge of the previously applied lattice support element, a new supporting surface or an upper end surface is planned.

Clearly, this work procedure, for a layer-by-layer construction of the fore-part lattice and of the load-bearing structure, offers the essential advantage that for each layer only one planing stage must be undertaken and that all work essentially takes place on one level.

In contrast thereto, the arrangement of FIG. 6 distinguishes itself by its particularly simple and work-saving assembly. The following work process is considered which, by the way, also realizes the specific advantages of the latter described process:

An initial supporting surface, possibly with inserted foundation or support elements, is planned from pourable or solidifiable bulk filler;

in alignment, in accordance with a predetermined position, at least one preferably rod-like anchoring connection element, which is already provided with at least one looping flexible anchoring element, is placed on the supporting surface;

the flexible anchoring element is laid out on the supporting surface and stretched in the provided anchoring direction of pull;

at least one lattice support element, which has at least one abutment and at least a downwardly directed deflection edge, is placed in the predetermined alignment on the anchoring connection element while tensioning the flexible anchoring element in such a way that the abutment grips behind the anchoring connection element in the anchoring direction of pull and supports same against this direction;

possibly, after additional fastening of the flexible anchoring element in the bulk filler located behind the lattice support element, bulk filler is applied to the supporting surface and the flexible anchoring element laid out there and preferably compressed; preferably at upper edge level of the previously placed lattice support element, a new supporting surface or an upper end surface is created.

Figure 7:
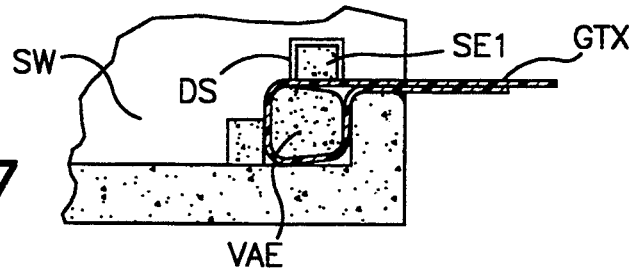
FIG. 7 is a view similar to FIG. 6 showing another anchor construction.
Figure 8:
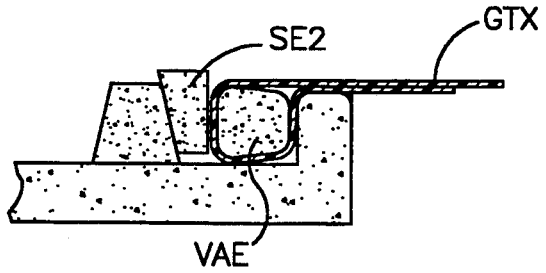
FIG. 8 is a view similar to FIG. 7 showing another anchor construction.
Figure 9:
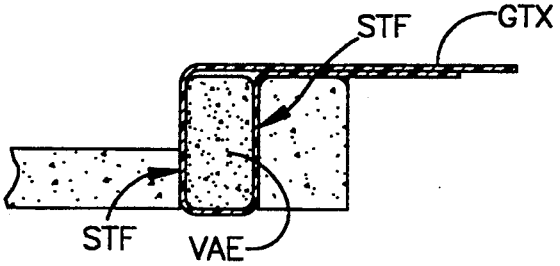
FIG. 9 is a view similar to FIG. 8 showing another anchor construction.

However, in the arrangements in accordance with the FIGS. 7 to 9, slit- or groove- or trough-like seats with opposing support or contact surfaces for the anchoring connection element are also provided with the aid of special steps for securing the position. In accordance with FIG. 7, a rod- or pin-like securing element (SE1) is placed into a form-adapted opening (DS) in the side walls (SW) of the lattice support element. This securing element supports the girder-like anchoring connection element from above and thus prevents a lifting of the latter under the effect of the pulling forces of the geotextile element. A similar result is achieved in the arrangement in accordance with FIG. 8 by means of a girder-like shim securing element (SE2), which is wedge-like in cross section and which also effects a support of the anchoring connection element against lifting and tilting, but does not require an opening in the side walls of the lattice support element. Again, a similar result is achieved with the arrangement, in accordance with FIG. 9, without any type of additional element through a comparably large difference in height between the support surfaces (STF) facing each other inside the receiving element for the anchoring connection element.

Figure 10:
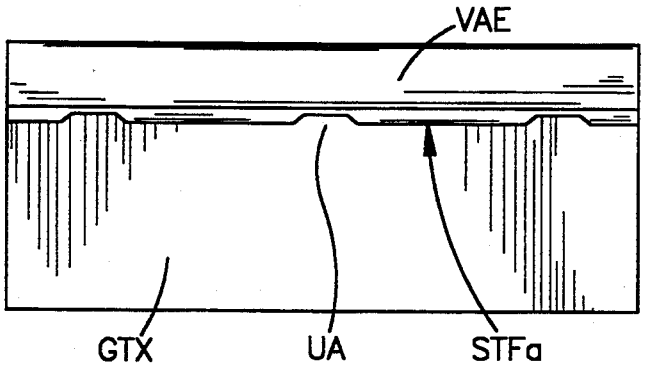
FIG. 10 shows a form of anchoring connection in accordance with another embodiment of the invention.

Furthermore, an undesirable wedging, which may possibly be undesirable due to the threat of damage, of the geotextile element between the concrete surfaces in the area of the anchoring connection element may be prevented in the manner shown in FIG. 10. Subsequently, the lattice support element will have at least one support surface (STFa), provided with interruptions or shoulders (UA), which engages only a predetermined number of sections, preferably only at both end sections of the anchoring connection element and, otherwise, extends at a [certain] distance from the anchoring connection element. Thus, the result is a flawless functional separation between the geotextile connection, on the one hand, and the form-locking connection between the connection element and the support element, on the other.

Figure 11:
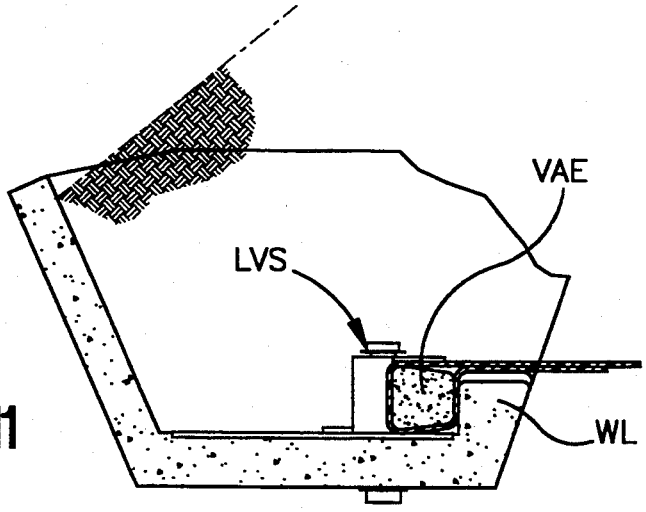
FIG. 11 illustrates yet another type of anchoring construction.
Figure 12:
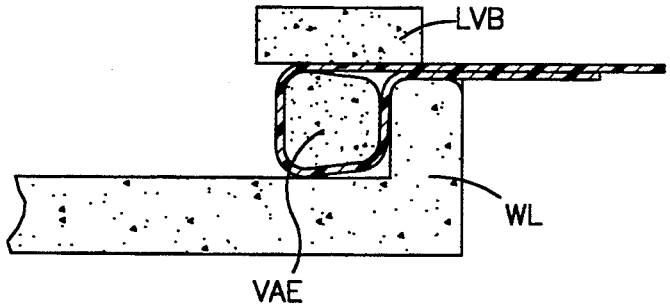
FIG. 12 illustrates a further type of anchoring construction.
Figure 13:
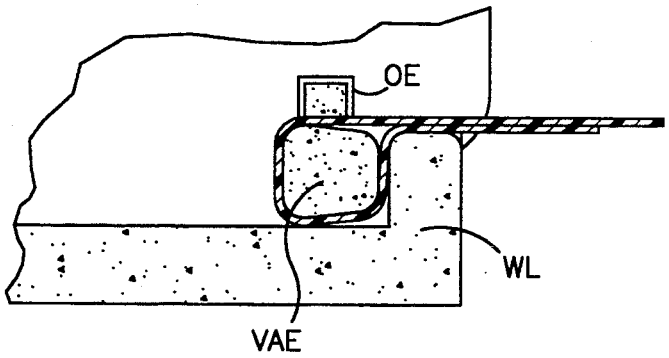
FIG. 13 illustrates yet another type of anchoring construction.

With the arrangements, in accordance with FIGS. 11 to 13, for the form-locking connection of pull-anchoring elements with lattice support elements, a preferably girder-like anchoring connection element is also provided, however, in connection with various form-locking arrangements for securing the position of the connection element. In accordance with FIG. 11, the position-securing arrangement is in the form of a screw connection (LVS) with a bracket joint engaging the connection element; however, in accordance with FIG. 12, it is in the form of a simple flat girder (LVB) which rests on the connection element, and due to its dead load and the load created by the bulk filler, creates a safety weight against lifting and tilting of the connection element. The securing device, in accordance with FIG. 13, is similar to the one in accordance with FIG. 7; however, here, the girder is envisioned as a securing element which extends across the entire width of the box-like lattice support element and which has been pushed through openings (OE) in both side walls and which omits a slit- or groove-like seat with two support surfaces.

Figure 14:
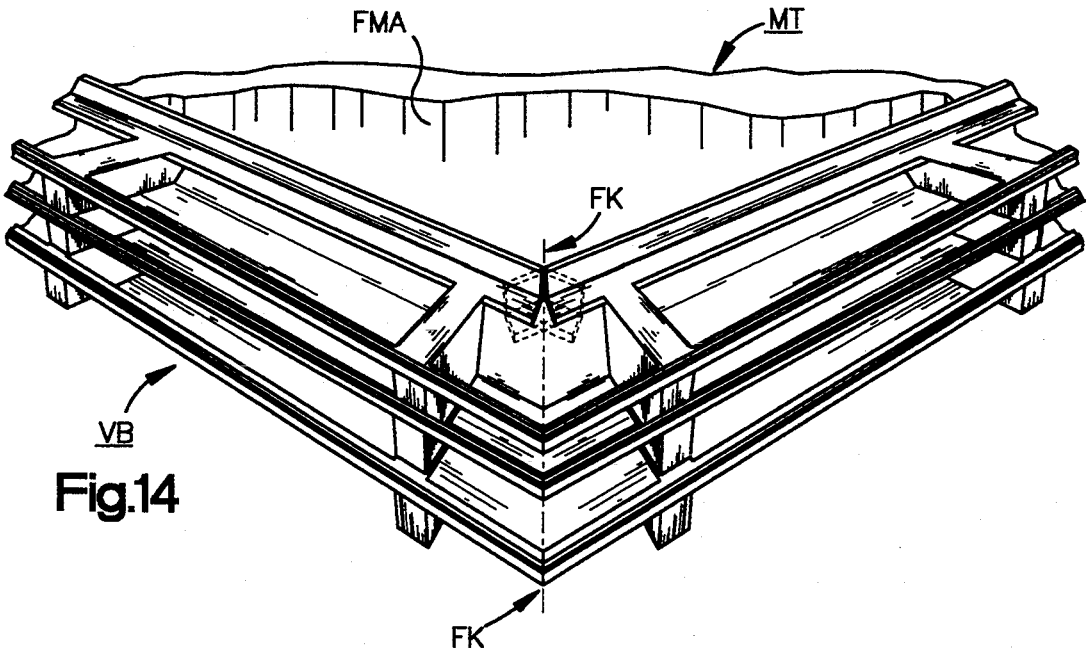
FIG. 14 illustrates a lattice structure in accordance with another embodiment of the present invention.

FIG. 14, in turn, shows a lattice structure with fore-part (VB) which is in the form of a lattice with solid support elements and is connected in a form-locking or frictionally-connected manner with a load-bearing support structure (MT), containing pourable or solidified bulk filler (FMA) and with the fore-part, wherein the fore-part has a number of support elements (FTE) which are arranged in the direction of width and height in a grid-like manner and are box- or frame-like. The distinctive feature here lies in the fact that in the area of an edge (FK) of the front surface of the lattice structure, extending parallel or in an acute angle to the vertical, at least a portion of the support elements, adjacent to this edge, in the assembly state, has at least side edges (SBK) which are nearly parallel to each other. This results in a certain protection of the bulk filler against being washed out and a satisfactory aesthetic effect for the facade.

Figure 15:
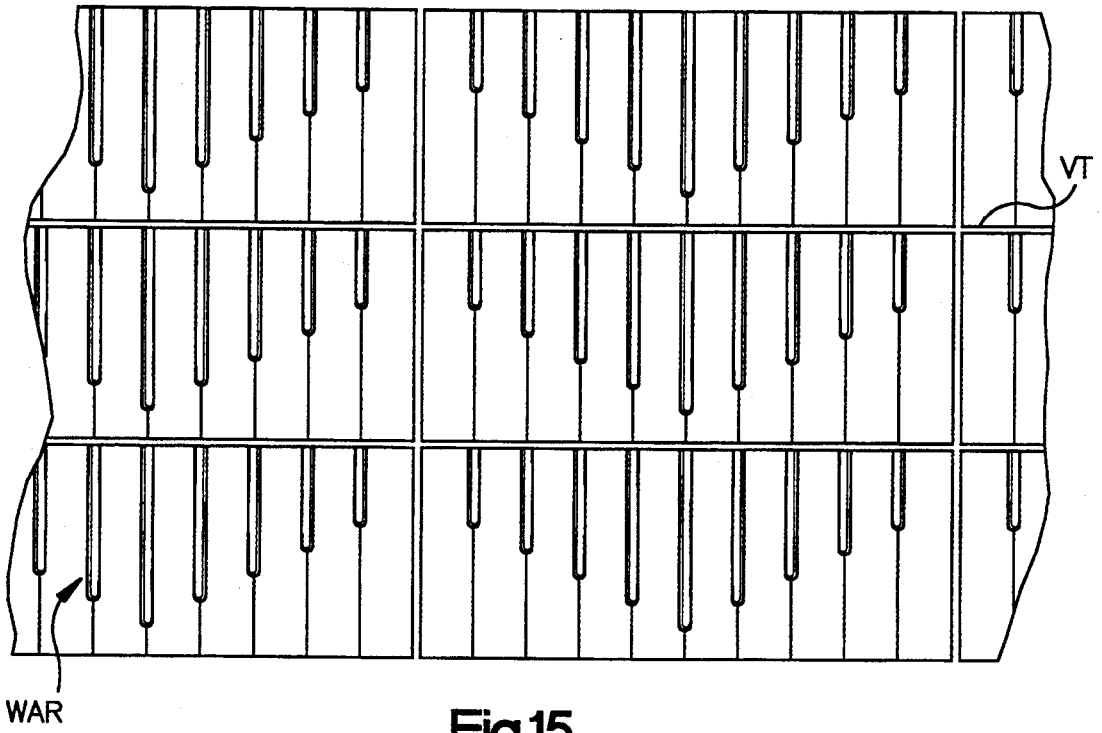
FIG. 15 shows a concrete structure having water run-off grooves.

FIG. 15 shows a concrete structure with flat front elements which are arranged side-by-side and one on top of the other. In the front surface of the structure, at least close to the direction of drop-off water run-off grooves (WAR) are formed which connect to a depression or juncture (VT) extending parallel or at an acute angle to the horizontal. The water run-off grooves have a broad upper and a narrower lower section, as well as a transition section arranged between them, with a partially pyramidal or conical surface. Such a facade formation prevents an irregular distribution of run-off, rain water and sediment, throughout of the visible surface, and thus permits an aesthetically pleasing facade structuring.

Figure 16:
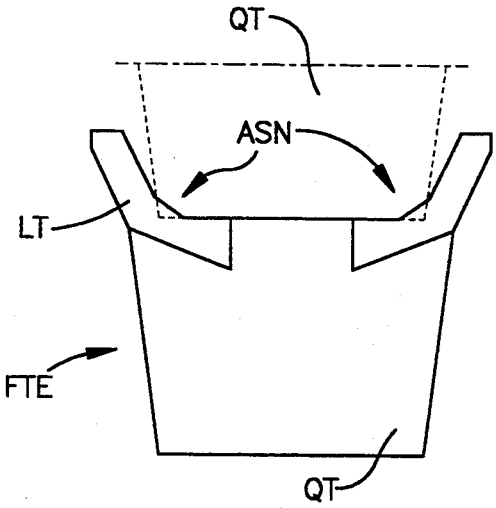
FIGS. 16 and 17 are partial sectional views of a lattice structure in accordance with another embodiment of the present invention.
Figure 17:
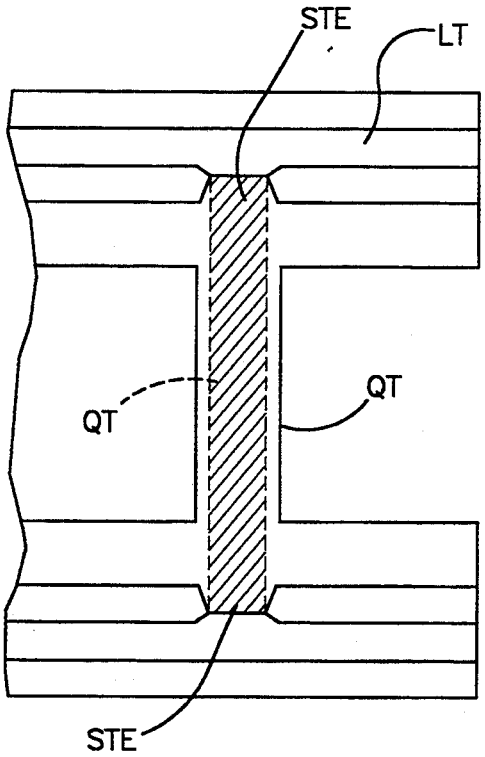

The FIGS. 16 and 17 show a partial section of a lattice structure with box- or frame-like support elements (FTE), which have at least a longitudinal support (LT) and at least a cross support (QT), molded or placed on the latter and/or a floor section (BA) [not shown]. In the area between the longitudinal support and the cross-support or floor section, recesses (ASN), which are open toward the top, are formed for engagement with support elements (STE) of an adjacent structural element. This permits, in a simple way, a form-locking securing of the position of the stacked supporting elements.

Figure 18:
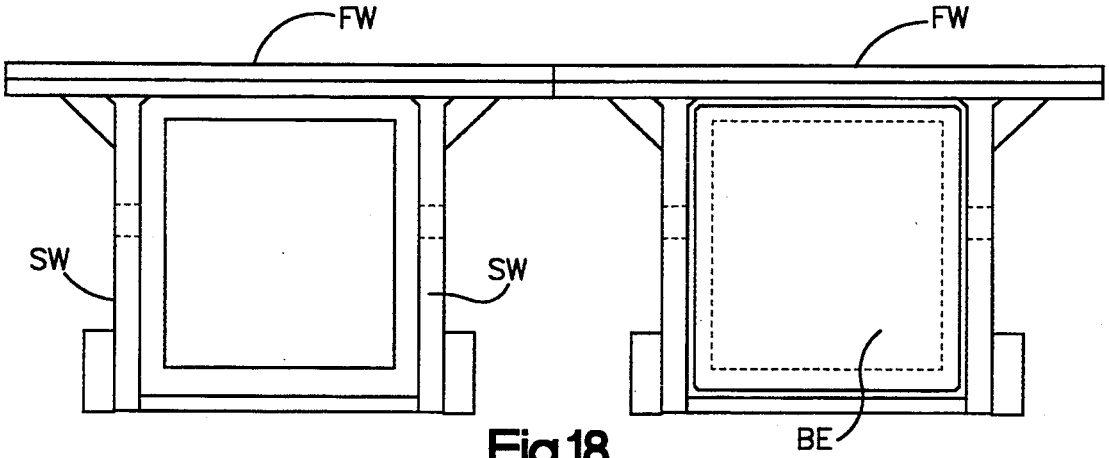
FIG. 18 is a plan view of a lattice structure including one or more floor elements.

FIG. 18 shows, in a planar view, two adjacent structural components for a lattice structure with at least one front element (FW) and at least two mutually spaced side elements (SW). Possibly, at least a rearward element may also be provided. Here, as a special feature, a floor element (BE) is provided which can be placed into the interior of the structural component and can be connected with the front element (FW) and/or the side elements (SW) in a form-locking manner. Furthermore, in accordance with FIG. 18, the front element is provided with at least one lateral demarcation, preferably with two opposing lateral demarcations, wherein at least one lateral demarcation, in a planar view, freely protrudes beyond the correspondingly adjacent lateral element. Here, the maximum height of the front element is smaller than the maximum height of the lateral element. Furthermore, it is of significance, that the floor element, with at least one lateral demarcation, preferably with two opposing lateral demarcations, freely protrudes, in a planar view, beyond the respectively adjacent lateral element. Furthermore, a lateral freely protruding floor section is arranged at a distance from the front element, preferably in the rearward area of a lateral element. Subsequently, lateral freely-protruding floor sections will be provided respectively between a freely-protruding front element and the outside of an adjacent lateral element. These may preferably be in the form of a triangle. Reinforcement elements, arranged in a bent-in angle between adjacent wall sections and connected in a retentive manner with these two wall sections, preferably in a single piece, yield an essential stabilization of the structural component while using little material. As can also be seen, to at least one wall section, projections with supporting surfaces for connecting elements are molded. Finally, similar to the arrangement explained by means of FIGS. 7 and 13, openings are formed for the insertion of rod-like supporting or holding elements in the lateral wall sections.

Figure 19:
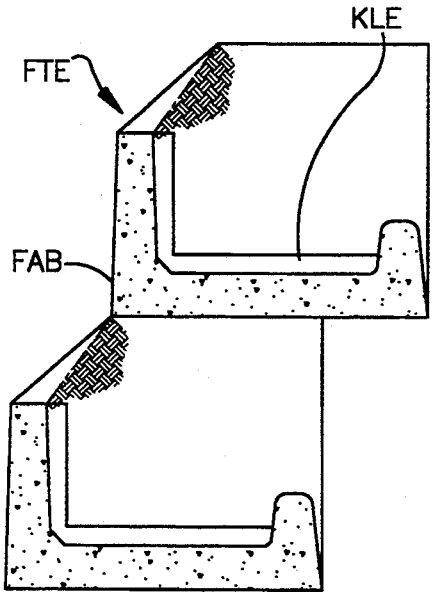
FIGS. 19 and 20 illustrate box-shaped structural parts inside a lattice structure in accordance with a final embodiment of the present invention.
Figure 20:
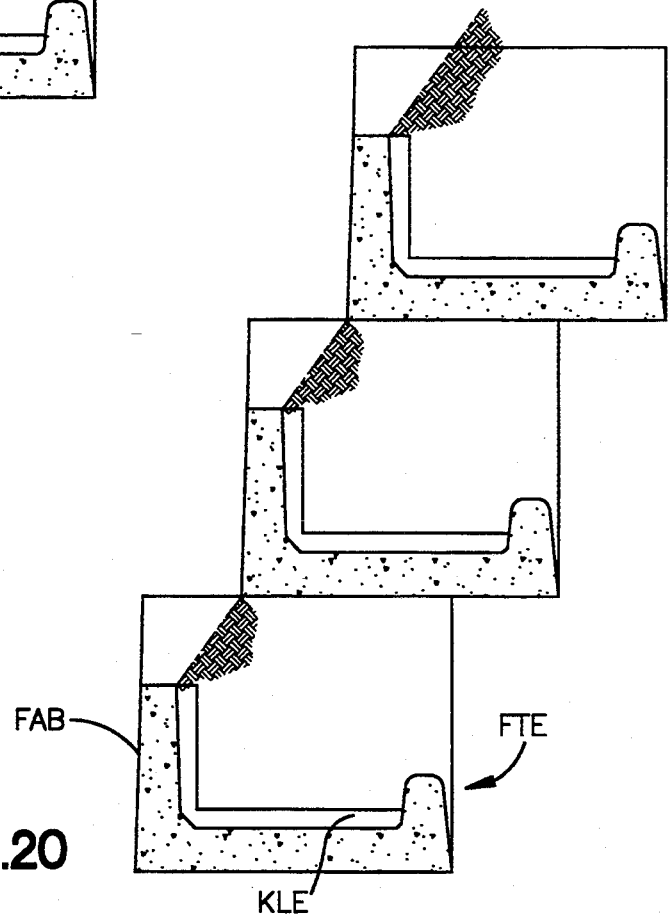

FIGS. 19 and 20 show box-like structural parts in grid-like composition inside a lattice structure. Each structural component is provided with a front wall, which is upright in cross section, and with equally erect transverse or lateral walls, as well as with a rear wall and a floor element. Here, a front wall of a lesser maximum height with respect to the transverse or side wall and, in the arrangement according to FIG. 19, a rearward inclined front edge of the transverse or side wall is essential. This arrangement permits a comparably large access for the plantable filling of the fore-part without influencing the support between the stacked structural components, i.e., without reducing the bonding strength of the fore-part.

Furthermore, it is essential that the front sections (FAB) of at least one part of the corresponding adjacent support elements (FTE) are connected by means of bridging elements (KLE) whose shape is adapted to the abutting profile contours. In this way, a washing-out of the bulk filler can be safely prevented.

I claim:

1. A construction, particularly a wall, comprising:

a fore-structure, and behind said fore-structure a bulk material filling;

the fore-structure and the bulk material filling being connected with each other by at least one flexible flat material sheet, preferably by a plurality of such sheets;

the fore-structure comprising at least one solid-body anchor around which is looped at least partially a flat material sheet and being in a force-transmitting connection with the fore-structure;

first and second sections of the flat material sheet extending under tension from the fore-structure into the bulk material filling and being secured therein;

the solid-body anchor engaging against at least one abutment disposed at a rear portion of the fore-structure so as to project upward or downward substantially transverse to the direction of tension of said flat material sheet;

the flexible flat material sheet after its loop around said anchor extending around said abutment to the bulk material filling, the first and second sections of said flat material sheet extending to and returning from said loop being in a force-transmitting relationship with each other.

2. A construction according to claim 1 in which said flat material sheet extends at least partially between said solid-body anchor and said abutment.

3. A construction according to one of claims 1 and 2, in which the fore-structure is formed as a space-lattice work composed of building elements arranged one above the other and/or side by side, and characterized in that there is at least one abutment being arranged at the back of each such building element and having a longitudinal edge projecting upward.

4. A construction, in particular a slope supporting wall or a stand-alone space partition wall, comprising at least one fore-structure (VB) formed as a space-lattice work with solid-body bearing elements, and further comprising at least one bearing-by-mass structure (MT) containing filling material, said bearing-by-mass structure being connected with the fore-structure by at least one flexible generally planar anchoring element in tension, and said fore-structure (VB) comprising a plurality of box-shaped bearing elements (FTE), which have preferably planar front parts (FAB) and which are arranged in a raster-like distribution extending in horizontal and vertical direction, in particular a construction according to anyone of the preceding claims, characterized in that at least for one space-lattice bearing element there is provided an at least partially elongated anchoring connection element (VAE) which extends substantially transverse to the anchoring tension direction and which is at least partially looped by at least one flexible anchoring element, preferably by a geotextile sheet (GTX), further characterized in that said space-lattice bearing element has at least one abutment (WL) being in operational connection with said anchoring connection element (VAE), which abutment (WL) has at least one supporting surface extending at an angle, preferably transverse, to the anchoring tension direction, and which abutment (WL) further has a diverting edge (UK) for said flexible anchoring element, the diverting edge (UK) projecting downward and also extending at an angle, preferably transverse, to the anchoring tension direction, the construction further being characterized in that the said flexible anchoring element extends below said diverting edge (UK) into the filling material of said bearing-by-mass structure.

5. Construction, in particular a slope supporting wall or a stand-alone space partition wall, comprising at least one fore-structure (VB) formed at least partially as a space-lattice work, and further comprising at least one bearing-by-mass structure (MT) containing filling material which is capable of being poured or in a solidified condition, said bearing-by-mass structure being connected positively or frictionally with the fore-structure by at least one flexible and preferably planar anchoring element in tension, and said fore-structure (VB) comprising a plurality of box-shaped bearing elements (FTE), which have preferably planar front parts (FAB) and which are arranged in a raster-like distribution extending in horizontal and vertical direction, in particular a construction according to any one of the preceding claims, characterized in that there is at least one space-lattice bearing element being provided with at least one anchoring connection element (VAE) which is at least partially of elongated shape and extends at an angle, preferably transverse, to the anchoring tension direction, and which anchoring connection element is at least partially looped by at least one flexible anchoring element, preferably by a geotextile sheet (GTX), the construction being further characterized in that on said space-lattice bearing element there is formed at least one receptacle (AFN) which in its shape is adapted to said anchoring connection element at least by sections and which has at least two supporting surfaces for the anchoring connection element, said supporting surfaces also extending at least partially at an angle, preferably transverse, to the anchoring tension direction.

6. Construction according to claim 5, characterized in that there is provided at least one groove-like or slot-like receptacle (AFN) for said anchoring connection element, said receptacle extending substantially transverse to the anchoring tension direction.

7. Construction according to claim 6, characterized in that there is provided at least one groove-like or slot-like receptacle (AFN) of trapezoidal cross-section and at least one beam-like anchoring connection element corresponding in shape.

8. Construction according to any one of the preceding claims, characterized in that there is provided at least one beam-like anchoring connection element, and in that there is a space-lattice bearing element having at least one supporting surface which engages only selected portions of said anchoring connection element, preferably only the end sections thereof, and which is spaced apart at other locations from said anchoring connection element.

9. Construction, in particular a slope supporting wall or a stand-alone space partition wall, comprising at least one fore-structure (VB) formed at least partially as a space-lattice work with solid-body bearing elements, and further comprising at least one bearing-by-mass structure (MT) containing filling material which is capable of being poured or in a solidified condition, said bearing-by-mass structure being connected positively or frictionally with the fore-structure by at least one flexible and preferably planar anchoring element in tension, and said fore-structure (VB) comprising a plurality of box-shaped bearing elements (FTE), which have preferably planar front parts (FAB) and which are arranged in a raster-like distribution extending in horizontal and vertical direction, in particular a construction according to any one of the preceding claims, characterized in that for establishing a positive connection of at least one anchoring element in tension with at least one space-lattice bearing element there is provided a preferably beam-like anchoring connection element, and in that there is provided at least one position securing device (LVS) capable of being connected with said space-lattice bearing element and engaging said anchoring connection element (VAE).

10. Construction according to claim 9, characterized in that said position securing device has at least one securing support element capable of being inserted in said bearing element so as to positively engage said beam-like anchoring connection element as well as at least one supporting surface of said bearing element.

11. Construction according to claim 10, characterized in that there is provided at least one securing support element which is also of beam-like shape and capable of being inserted in said bearing element in parallel to said anchoring connection element.

12. Construction, in particular a slope supporting wall or a space partition wall, comprising at least one fore-structure (VB) formed at least partially as a space-lattice work with solid-body bearing elements, and further comprising at least one bearing-by-mass structure (MT) containing filling material which is capable of being poured or in a solidified condition, said bearing-by-mass structure being connected positively or frictionally with the fore-structure, and said fore-structure (VB) comprising a plurality of box-shaped bearing elements (FTE), which have preferably planar front parts (FAB) and which are arranged in a raster-like distribution extending in horizontal and vertical direction, in particular a construction according to any one of the preceding claims, characterized in that intermediate bearing elements (ZTF, ZTS) which preferably extend horizontally and along a wall plane (E—E) are connected with at least part of said bearing elements (FTE) and are connected with neighboring sections of said bearing elements.

13. Construction according to claim 12, characterized in that at least one intermediate bearing element (ZTF) is secured to neighboring sections of one and the same space-lattice bearing element (FTE) by means of positive lock-in connections (FR).

14. Construction according to claim 12, characterized in that there is at least one intermediate bearing element (ZTF) which is materially connected, in particular by a unique-piece connection, with neighboring sections of one and the same space-lattice bearing element (FTE).

15. Construction according to one of claims 12 to 14, characterized in that there is at least one intermediate bearing element which is connected with a front region of a space-lattice bearing element or of two neighboring space-lattice bearing elements.

16. Construction according to any one of claims 12 to 15, characterized in that there is at least one intermediate bearing element which is connected with a back region of a space-lattice bearing element.

17. Construction according to any one of claims 12 to 16, characterized in that there is at least one intermediate bearing element which is connected with a lower region of a space-lattice bearing element.

18. Construction according to any one of claims 12 to 17, characterized in that there is at least one intermediate bearing element which is connected with an upper region of a space-lattice bearing element.

19. Construction according to any one of claims 12 to 18, characterized in that there is at least one intermediate bearing element (ZTR) which is embedded in filling material (FMA) which is capable of being poured or in a solidified condition.

20. Construction according to any one of claims 12 to 19, characterized in that there is at least one intermediate bearing element which is connected by means of at least one flexible anchoring element, in particular by means of a geotextile sheet (GTX), with the filling material (FMA) of the bearing-by-mass structure (MT).

21. Construction, in particular a slope supporting wall or a stand-alone space partition wall, comprising at least one fore-structure (VB) formed at least partially as a space-lattice work with solid-body bearing elements, and further comprising at least one bearing-by-mass structure (MT) containing filling material which is capable of being poured or in a solidified condition, said bearing-by-mass structure being connected positively or frictionally with the fore-structure, and said fore-structure (VB) comprising a plurality of box-shaped bearing elements (FTE), which have preferably planar front parts (FAB), in particular a construction according to any one of the preceding claims, characterized in that said front sections (FAB) at least of some of the front bearing elements (FTE) located adjacent to each other are connected by intermediate bearing elements (KLE).

22. Construction, in particular a slope supporting wall or a stand-alone space partition wall, comprising at least one fore-structure (VB) formed at least partially as a space-lattice work with solid-body bearing elements, and further comprising at least one bearing-by-mass structure (MT) containing filling material which is capable of being poured or in a solidified condition, said bearing-by-mass structure being connected positively or frictionally with the fore-structure, and said fore-structure (VB) comprising a plurality of box-shaped bearing elements (FTE), which have preferably planar front parts (FAB), in particular a construction according to any one of the preceding claims, characterized in that in the region of at least part of re-entrant or projecting front face edges of the construction extending in parallel or at an acute angle to the vertical, the bearing elements which are located adjacent to said edges have side limitation edges which extend at least approximately parallel to each other.

23. Construction of concrete with front elements arranged side by side and one above the other according to claim 1 characterized in that in the front face of the construction there are formed water drain-off grooves, which extend generally parallel to the line of slope and which are connected to an indentation or joint fissure located thereabove and extending in parallel or at an acute angle to the horizontal.

24. Construction of concrete with front elements arranged side by side and one above the other, according to claim 23, characterized in that at least some of said water drain-off grooves include an upper section of greater width and a lower section of smaller width as well as an intermediate transition section having a surface which is shaped like part of a cone or pyramid.

25. A box-shaped building element for a space-lattice work, in particular for a construction according to claim 11 or 12, comprising at least one longitudinal beam (LT) and at least one transverse beam (QT) and/or a bottom section (BA) formed uniquely with or attached to said longitudinal beam, characterized in that in the region between the longitudinal beam (LT) and the transverse beam (QT) or the bottom section (BA) respectively there are provided excavations (ASN) being open upward for engagement by support elements (STE) of a neighboring building element.

26. A box-shaped building element for a space-lattice work, comprising at least one front element (FW) and at least two side elements (SW) being arranged with mutual distance as well as eventually a back element, in particular a building element according to claim 25, characterized in that there is provided at least one bottom element (BE) capable of being inserted in the internal space of the building element and capable of being positively connected with said front element (FW) and/or with said side elements (SW).

27. A box-shaped building element for a space-lattice work, comprising at least one front element (FW), at least two side elements (SW) arranged with mutual distance, and eventually at least one back element and at least one bottom element, in particular according to claim 26, characterized in that the front element is connected with at least one side limitation, preferably with two side limitations arranged oppositely to one another, and further characterized in that said front element projects beyond the adjacent side element in horizontal and/or in vertical direction.

28. A box-shaped building element for a space-lattice work, comprising at least one front element (FW), at least two side elements (SW) arranged with mutual distance, at least one bottom element and eventually at least one back element, in particular according to claim 26, characterized in that least one side limitation, preferably two oppositely arranged side limitations, of the bottom element project beyond the adjacent side element.

29. A box-shaped building element according to claim 28, characterized in that there is at least one laterally projecting bottom section arranged with distance from the front element and preferably at the rear of a side element.

30. A box-shaped building element for a space-lattice work, comprising at least two, preferably at least three wall sections which are arranged in relation to one another under angles, preferably under at least approximately right angles, in particular according to claim 25, characterized in that a reinforcing element is provided within a re-entering angle formed between adjacent wall sections, said reinforcing element being connected materially, preferably by a unique-piece connection, at least with both said adjacent wall sections.

31. A frame-like building element for a space-lattice work, comprising at least two, preferably at least three wall sections which are arranged in relation to one another under angles, preferably under at least approximately right angles, in particular according to claim 25, characterized in that in at least one wall section there is formed at least one hole for inserting therein a preferably rod-like bearing or holding element.

32. A box-shaped building element for a space-lattice work, comprising at least one front wall and at least one transverse or side wall, which walls are arranged so as to stand upright, and eventually further comprising at least one back wall and at least one bottom element, in particular a building element according to claim 25, characterized in that said front wall in relation to said transverse or side wall has a smaller maximum height, and further characterized in that the front edge of said transverse or side wall slopes rearward.

33. A retaining wall comprising:

a fore-structure including a material supporting member, at least one abutment on said material supporting member, and at least one solid body anchor member;

a bulk material filling disposed rearward of said fore-structure and having a portion acting with a forwardly-directed force on said fore-structure; and at least one flexible sheet material member interconnecting said fore-structure and said bulk material filling for resisting forward movement of said fore-structure under the influence of said forwardly-directed force from said bulk material filling;

said abutment having at least one abutment surface, said solid body anchor member being disposed forward of said abutment surface, said abutment surface blocking rearward movement of said solid body anchor member relative to said material supporting member;

said sheet material member having a loop section extending at least partially around said solid body anchor member, at least a portion of said loop section of said sheet material member extending between said solid body anchor member and said abutment surface;

said sheet material member having first and second end sections connected with said loop section, said end sections of said sheet material member extending rearward from said loop section and from said fore-structure in a direction into said bulk material filling, said end sections of said sheet material member being disposed in an overlying force-transmitting relationship with each other, said end sections of said sheet material member being anchored in said bulk material filling to place said sheet material member in tension under the influence of said forwardly-directed force from said bulk material filling;

said abutment surface extending in a direction generally transverse to the direction of tension of said sheet material member.

34. A retaining wall as set forth in claim 33 wherein said end sections of said sheet material member extend in a generally horizontal direction into said bulk material filling;

at least portions of said end sections of said sheet material member being in abutting engagement with each other in said bulk material filling; and at least a portion of said bulk material filling being disposed above said end sections of said sheet material member and exerting a downwardly-directed force on said end sections to resist movement of said end sections out of said bulk material filling under the influence of said forwardly-directed force.

35. A retaining wall as set forth in claim 34 wherein said material supporting member and said solid body anchor member are made from concrete, said abutment being formed as one piece with said material supporting member, said loop section of said sheet material member extending completely around said solid body anchor member.

* * * * *